United States Patent [19]

Colle, Jr. et al.

[11] Patent Number: 4,614,156

[45] Date of Patent: Sep. 30, 1986

[54] PRESSURE RESPONSIVE EXPLOSION INITIATOR WITH TIME DELAY AND METHOD OF USE

[75] Inventors: Edward A. Colle, Jr., Houston; Flint R. George; Donald N. Yates, Jr., both of Katy, all of Tex.

[73] Assignee: Halliburton Company, Duncan, Okla.

[21] Appl. No.: 816,975

[22] Filed: Jan. 6, 1986

Related U.S. Application Data

[63] Continuation of Ser. No. 587,345, Mar. 8, 1984, abandoned.

[51] Int. Cl.[4] ..... F42B 1/02

[52] U.S. Cl. ..... 102/312; 102/313; 102/322; 102/275.3; 102/275.11; 89/1.13; 166/63

[58] Field of Search ..... 102/200, 275.3, 275.11, 102/312, 313, 322; 166/63; 89/1.13; 299/13

[56] References Cited

U.S. PATENT DOCUMENTS

| | | | |
|---|---|---|---|
| 2,125,487 | 8/1938 | Church | 164/0.5 |
| 2,327,141 | 8/1943 | Spencer | 164/0.5 |
| 2,595,615 | 5/1952 | Sweetman | 102/200 X |
| 2,655,993 | 10/1953 | Spencer | 164/0.5 |
| 2,707,439 | 5/1955 | Hamilton | 102/275.3 |
| 2,754,760 | 7/1956 | Wynn | 102/71 |
| 3,010,515 | 11/1961 | Harrison et al. | 166/54.5 |
| 3,174,545 | 3/1965 | Mohaupt | 102/313 X |
| 3,277,785 | 10/1966 | Clayton | 89/1 |
| 3,391,263 | 7/1968 | Young | 200/82 |
| 3,491,841 | 1/1970 | Robinson | 175/4.5 |
| 3,762,267 | 10/1973 | Travor et al. | 102/275.11 |
| 4,208,966 | 6/1980 | Hart | 102/313 X |
| 4,250,960 | 2/1981 | Chammis | 166/63 X |
| 4,429,741 | 2/1984 | Hyland | 89/1 B X |
| 4,513,665 | 4/1985 | Ricketts et al. | 102/312 |
| 4,522,129 | 6/1985 | Jerberyd | 102/312 X |
| 4,530,396 | 7/1985 | Mohaupt | 102/313 X |

FOREIGN PATENT DOCUMENTS

| | | | |
|---|---|---|---|
| 2040025 | 8/1980 | United Kingdom | 102/275.3 |

*Primary Examiner*—Peter A. Nelson
*Attorney, Agent, or Firm*—James R. Duzan

[57] ABSTRACT

A device for actuating an explosive charge downhole in a wellbore. The device includes a combustive reaction initiator actuated in response to a first pressure condition in a portion of the wellbore and an explosive charge actuator. A time delay device is provided wherein a combustive reaction is initiated by the initiator and continues for a time delay period providing sufficient time for an operator to alter the first pressure condition to a second pressure condition desired at the time of explosive actuation. The delay device is operative at the end of the time delay period after initiation to actuate the explosive charge.

29 Claims, 6 Drawing Figures

FIG. 3
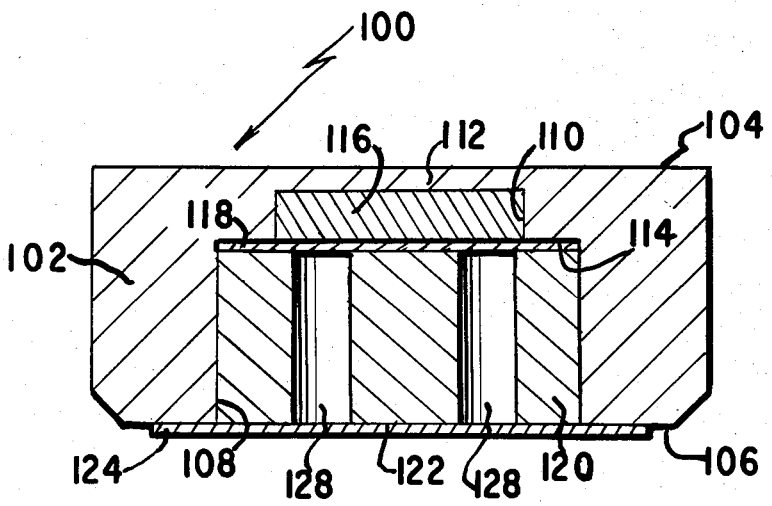
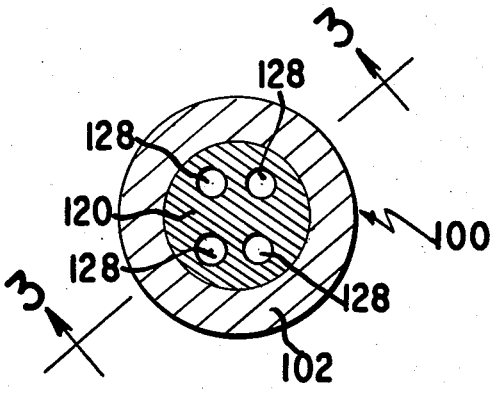
FIG. 2

PRESSURE RESPONSIVE EXPLOSION INITIATOR WITH TIME DELAY AND METHOD OF USE

This application is a continuation of application Ser. No. 587,345 filed Mar. 8, 1984, and now abandoned.

BACKGROUND OF THE INVENTION

The present invention relates to devices for use in actuating an explosive charge downhole in a wellbore.

Explosive charges are utilized in wellbores to perform various functions, for example, to perforate a well casing to complete or test a formation, or to set a packer or other device downhole. Due to the time and expense involved in these operations and the explosive power of these devices, it is essential that their operation be reliable. The typical wellbore environment poses severe difficulties for the operation of explosive devices downhole, which thus tends to reduce their reliability. For example, extremes of temperature are common which tend to degrade the operation of explosives, and the presence of heavy drilling muds and debris can interfere with a firing apparatus. Impact responsive firing heads can become fouled by debris and particles settling out from the drilling mud.

In some applications, it is not feasible to utilize an impact responsive firing head. In drill stem testing, a zone to be tested is perforated and various downhole parameters such as temperature and pressure are monitored by instruments mounted between the tubing and the firing head. These are non-fullbore opening devices which typically do not permit a detonating bar to pass through to the firing head. In these applications, therefore, pressure responsive firing devices are desired for use.

A complication introduced in the use of pressure responsive firing, devices is that they require the manipulation of pressure in the annulus or the tubing to actuate the firing device. There are, however, numerous applications which call for the maintenance of a relatively low pressure at the time of explosive actuation, such as where it is desired to perforate the casing underbalanced. This requirement may not be compatible, therefore, with the use of pressure responsive firing devices operated by increasing pressure above hydrostatic.

SUMMARY OF THE INVENTION

In accordance with one aspect of the present invention, a device is provided for actuating an explosive charge downhole in a wellbore. The device comprises first means for initiating a combustive reaction and actuated in response to a first pressure condition in at least a portion of the wellbore and second means for actuating the explosive charge. The device also includes delay means for providing a combustive reaction initiated by the initiating means and continuing for a time delay period providing sufficient time for an operator to alter the first pressure condition to a second pressure condition desired at the time of explosive actuation. The delay means is operative at the end of the time delay period after initiation to actuate the explosive charge. Accordingly, it is thus possible to actuate the explosive charge by means of pressure downhole, while having the capability of reducing the pressure to a desired value, for example, a value desired for shooting underbalanced, before the perforating guns are actuated.

In accordance with a preferred embodiment of the present invention, the device further comprises means for providing a signal indicating the actuation of the first means in a form adapted to be transmitted to the surface of the wellbore. Accordingly, the operator can be informed that the delay means has been actuated so that he can begin to bleed off pressure in the wellbore, if so desired, prior to actuation of the explosive.

In accordance with a further aspect of a preferred embodiment, the delay means is disposed in a chamber to which it is adapted to release combustion gas as its combustive reaction proceeds. The device further comprises means for venting the combustion gas released by the delay means from the chamber outwardly of the device. Thus, heat and pressure from the delay means is dissipated outside the device as the combustive reaction proceeds. This aids in preventing a build up of temperature and pressure in the chamber which, if not prevented, will cause the time delay to become unpredictable.

In accordance with a further aspect of the present invention a method is provided of perforating the casing of a cased borehole at a desired location and at a desired perforating pressure condition within the casing adjacent the desired location. The method comprises the steps of positioning a perforating means adjacent the desired location; increasing the pressure within the casing adjacent the desired location from a first condition to a second, initiating pressure condition greater than the first condition and the desired perforating pressure condition, to initiate a time delayed perforation of the casing; and thereafter reducing the pressure within the casing adjacent the desired location from the initiating pressure condition to the desired perforating pressure condition prior to the perforation of the casing.

BRIEF DESCRIPTION OF THE DRAWINGS

The present invention, as well as further objects and features thereof, will be understood more clearly and fully from the following description of certain preferred embodiments, when read with reference to the accompanying drawings, in which:

FIG. 2 is a cross-sectional view taken along the lines 2—2 in FIG. 1 of a primer assembly for use in the device thereof;

FIG. 3 is a cross-sectional view taken along the lines 3—3 in FIG. 2;

DETAILED DESCRIPTION OF CERTAIN PREFERRED EMBODIMENTS

Figure 1:
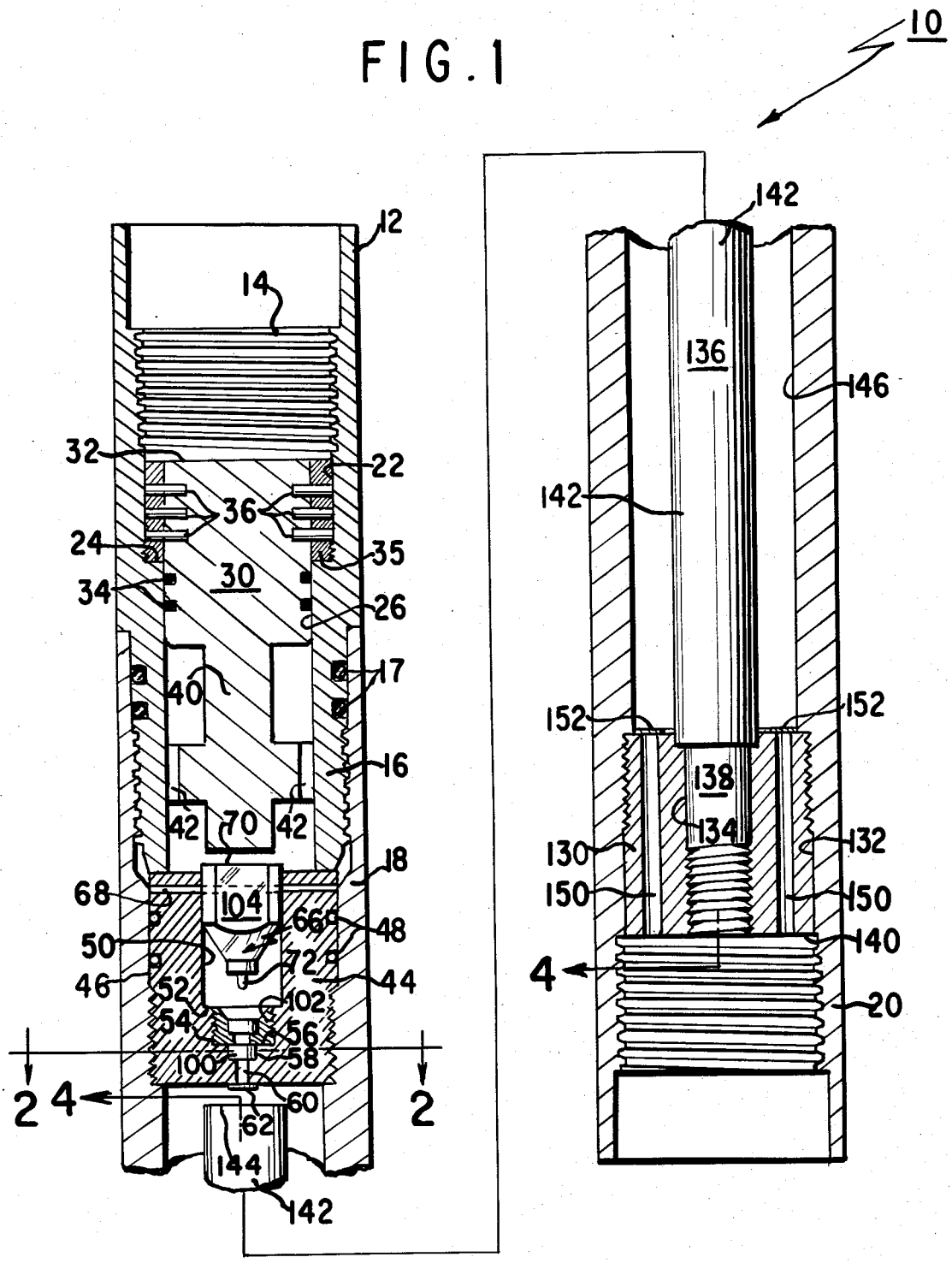
FIG. 1 is a partially cross-sectional view of a device in accordance with one embodiment of the present invention for actuating an explosive charge downhole in a wellbore.

With reference first to FIG. 1, the device 10 thereof includes an upper sub 12 having an upper set of threads 14 for coupling the device 10 to a tubing string for lowering into a well, or for coupling other downhole devices to device 10.

Upper sub 12 has a reduced diameter, lower portion 16 forming a pin threadedly coupled to a housing 18 and sealed thereagainst by a pair of O-rings 17. Housing 18 is threaded at a lower portion 20 thereof for coupling the device 10 to a perforating gun or other downhole explosive device.

Immediately beneath the threaded portion 14, upper sub 12 has a first relatively large diameter counterbore 22 bounded at its lower extremity by an annular shoulder 24. Beginning at an inner edge of shoulder 24 is a downwardly extending second, relatively smaller diameter counterbore 26 extending through a lower extremity of upper sub 12. A piston ram 30 has an upper piston 32 fitting closely against the counterbore 26 of upper sub 12 and having two O-ring seals 34 providing a fluid tight seal between the piston 32 and the counterbore 26. Piston 32 extends upwardly from counterbore 26 and is spaced concentrically from counterbore 22. An annularly shaped piston retainer 35 is fitted within and threadedly coupled to the counterbore 22 and is prevented from moving downwardly within upper sub 12 by the shoulder 24. Retainer 35 has an inner surface dimensioned to fit closely against the outer surface of the piston 32. In the embodiment of FIGS. 1–6 six shear pins 36 couple the piston ram 30 to the piston retainer 35 to restrain the piston ram 30 against movement downwardly with respect to upper sub 12 until such time as a sufficient pressure differential is applied across the piston 32 of piston ram 30 to shear the pins 36. Piston ram 30 also includes a downwardly extending, reduced diameter projection 40 having a plurality of radially extending fins 42 which serve in part to center the projection 40 in the counterbore 26. Fins 42 also limit the downward travel of ram 30, as described more fully below.

Immediately below the upper sub 12 and piston ram 30, a generally cylindrical upper plug 44 is threadedly retained within a counterbore 46 of the housing 18. Upper plug 44 has a pair of O-ring seals 48 forming a fluid tight seal with the housing 18 at the counterbore 46. Upper plug 44 has a first concentric relatively large diameter counterbore 50 extending from an opening in an upper surface of the plug 44 downwardly to an inwardly extending shoulder 52. Extending downwardly from an inner extremity of the shoulder 52 is a second relatively smaller diameter concentric counterbore 54 which terminates at a shoulder 56. Extending downwardly from an inner extremity of shoulder 56 is a third counterbore 58 having yet a smaller diameter. Extending from the counterbore 58 through the lower extremity of upper plug 44 is a relatively small concentric cylindrical opening 60. The lower extremity of opening 60 is hermetically sealed by a circular stainless steel closure disk 62 spot welded to the upper plug 44.

A firing pin 66 is held within the counterbore 50 and above the counterbore 54 by a shear pin 68. Firing pin 66 has an upper surface 70 positioned to receive the impact of projection 40 of piston ram 30 in order to force the firing pin 66 downwardly within counterbore 50 of upper plug 44. A lower portion of firing pin 66 is formed as a relatively narrow projection 72 which impacts against a percussion primer assembly 100 when the firing pin 66 is forced downwardly from counterbore 50. Assembly 100 is held within counterbore 58 by a primer retainer 102 which is threaded into counterbore 54. Retainer 102 has a concentric opening therethrough shaped to receive the lower portion of firing pin 66 and guide the projection 72 into engagement with the primer assembly 100. The firing pin 66 has a number of depressions 104 in an outer surface of its upper, relatively large diameter portion to permit air beneath firing pin 66 to flow upwardly past it as firing pin 66 moves downwardly.

With reference to FIGS. 2 and 3, the percussion primer assembly 100 includes a generally cylindrical primer cup 102 having an upper flat surface 104 and a lower flat surface 106. The surface 106 has a concentric, cylindrical bore 108 formed therethrough toward surface 104. A concentric, cylindrical counterbore 110 also is formed in cup 102 from an upper boundary of bore 108 and terminating a short distance from surface 104, thus to form a thin wall or web 112 therebetween. Counterbore 110 forms an annular shoulder 114 at the upper boundary of bore 108. Primer cup 102 may be made, for example, of stainless steel.

Counterbore 110 is filled with a primer mix 116, described in greater detail below. A stainless steel closure disc 118 is positioned against shoulder 114 to retain the primer mix 116 in counterbore 110. Disc 118 is pressed upwardly against shoulder 114 by a cylindrically shaped stainless steel anvil 120 positioned within bore 108. A lower surface 122 of anvil 120 is flush with surface 106. A second stainless steel closure disc 124 is spot welded to surface 106 to support the anvil 120 within cup 102 and to provide a hermetic seal to protect the primer mix 116 against moisture as well as gases produced by other pyrotechnic material in the device 10.

The primer mix 116 is a pyrotechnic mixture of titanium and potassium perchlorate mixed in a weight ratio of 41% titanium to 59% potassium perchlorate. The titanium is provided in powdered form with particles ranging from 1 to 3 microns in diameter and the potassium perchlorate is provided in powdered form with particles less than 10 microns in diameter. After the powders are thoroughly mixed, they are compacted in counterbore 110 perferably with a pressure of 40,000 psi. Thereafter, the disc 118, the anvil 120 and the closure disc 124 are in turn assembled with the cup 102 and primer mix 116. Further details of the primer mix 116 are disclosed in U.S. application Ser. No. 587,344 entitled PRIMER MIX, PERCUSSION PRIMER AND METHOD FOR INITIATING COMBUSTION, filed on even date herewith.

The thickness of the web 112 and the depth of the counterbore 110, together with the compaction of the primer mix 116, are selected to achieve the desired impact sensitivity. That is, as the thickness of web 112 is increased, impact sensitivity of the primer mix 116 in the assembly 100 is decreased, and as the depth of counterbore 110 is increased, so likewise is the impact sensitivity decreased. Moreover, as the density of the primer mix is increased (by increasing the compaction pressure), so also is the impact sensitivity lowered. In the disclosed embodiment, the thickness of the web 112 is nominally 0.011 inch thick and the depth of the counterbore 110 is nominally 0.035 inch deep. Where the primer mix is compacted from 68% to 81% of crystal density in this housing, an impact sensitivity in excess of 4 ft.-lbs. can be achieved and often is.

In use, the projection 72 of firing pin 66 impacts the web 112 to deform it inwardly, thus forcing the primer mix 116 against the anvil 120 to ignite it. Web 112 is made sufficiently thin so that it will be deformed adequately by the impact of the projection to ensure ignition. Upon ignition, the hot gases thus produced shatter the thin closure disc 118. Anvil 120 is provided with four longitudinally extending openings 128 therethrough which then form four jets of hot ignition gas and steel particles from disc 118. These jets of gas then burst through disc 124 to provide a means of igniting a flash sensitive, first fire mix, such as A1A.

With reference again to FIG. 1, a lower plug 130 is threadedly received within a counterbore 132 of the lower portion 20 of housing 18. Lower plug 130 has a central aperture 134 therethrough with a threaded lower portion. An elongated, generally cylindrical delay element assembly 136 is threaded at a reduced diameter lower portion 138 thereof. Portion 138 of assembly 136 is threaded into the aperture 134 so that a lower surface of portion 138 is flush with a lower surface 140 of plug 130. An upper relatively larger diameter portion 142 of assembly 136 extends upwardly from plug 130. An upper surface 144 of portion 142 is disposed adjacent aperture 60 of upper plug 44. Housing 18 has a further counterbore 146 spaced from upper portion 142 of assembly 136 to define a plenum chamber therebetween.

In operation, the jet of gases and hot particles emitted through aperture 60 by primer assembly 100 in response to the impact of projection 72 of firing pin 66 acts as a signal to initiate a combustive reaction within assembly 136. This combustive reaction proceeds for a period of time sufficient to permit an operator at the wellhead to reduce the pressure in the well to a lower value desired at the time that the perforating guns are detonated by the device 10. At the end of this time delay, a detonation initiator within the lower end of portion 138 detonates a detonating cord (not shown) coupled to the lower end of portion 138 in order to detonate the guns. As the combustive reaction proceeds within assembly 136, combustion gas exits from assembly 136 and fills the plenum chamber.

Lower plug 130 is provided with a plurality of vent apertures 150 therethrough and sealed at their upper ends by closure discs 152. As the combustion gases accumulate within the plenum chamber, they build up a slight pressure differential across the closure discs 152, causing them to rupture and permit the gases to pass downwardly through the apertures 150 so that the gases vent into the gun carriers coupled with the lower portion 20 of housing 18. Since the interior of the device 10 below the piston 32 of the piston ram 30 is sealed against fluid pressure and the gun carrier likewise is sealed against fluid pressure, the pressure within the plenum chamber will remain essentially at one atmosphere. In addition, the venting of the combustion gases dissipates heat from the assembly 136. Accordingly, the principal factor in determining the length of the delay provided by the delay element assembly 136 is the downhole ambient temperature.

Figure 4:
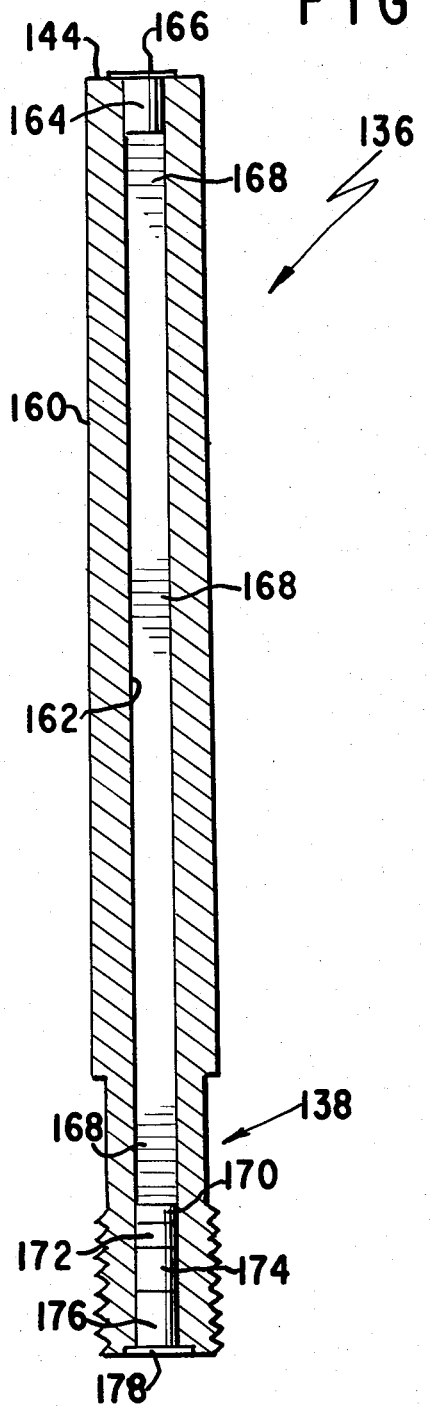
FIG. 4 is a partially cross-sectional view taken along the lines 4—4 in FIG. 1.

With reference to FIG. 4, delay element assembly 136 includes a generally cylindrical housing 160 having a central cylindrical aperture 162. A cylindrical pellet 164 of A1A first fire mix is positioned within aperture 162 so that an upper surface of pellet 164 is flush with the surface 144 of assembly 136 and extends downwardly a short distance therefrom. Aperture 162 is closed at surface 144 by an adhesive high temperature closure disc 166. Upon the ignition of primer assembly 100, the jet of hot gases and particles emitted through aperture 60 breaks through the closure disc 166 and ignites the A1A pellet 164.

A succession of tungsten composition discs 168 are positioned within aperture 162 to extend from pellet 164 downwardly to a point within aperture 162 approximately half way through the extent of aperture 162 through lower portion 138. In one embodiment, 55 tungsten composition discs (mil-T-23132) were utilized, each disc having 500 milligrams of composition compressed at 30,000 psi and forming a column approximately 10 inches high. It was found that this embodiment provides a burn time of 460 seconds at room temperature, a burn time of 420 seconds at 250° F. after heating at 250° F. for 100 hours, a burn time of 388 seconds at 300° F. after heating at 300° F. for 100 hours, and a burn time of 312 seconds at 400° F. after heating at 400° F. for 100 hours.

Positioned within the aperture 162 immediately below the lowermost tungston disc 168 is a second pellet of A1A 170. Immediately below the pellet 170 is a pellet of a titanium/potassium perchlorate flash charge 172. Immediately below the pellet 172 is a detonator having an upper booster 174 of lead azide (RD-1333) and a lower high explosive output charge 176 which may be either PYX or HNS-II. Aperture 162 is closed at its lower end by a closure disc 178 spot welded to the housing 160. When the last tungsten delay element 168 has burned through, it ignites the A1A charge 170 which in turn ignites the charge 172 which serves to provide a deflagrating output to the booster 174 which in turn detonates the high explosive output charge 176. This detonation is transferred to the detonating cord of the perforating guns to cause them to fire, and may thus be regarded as an explosive actuation signal.

Figure 5:
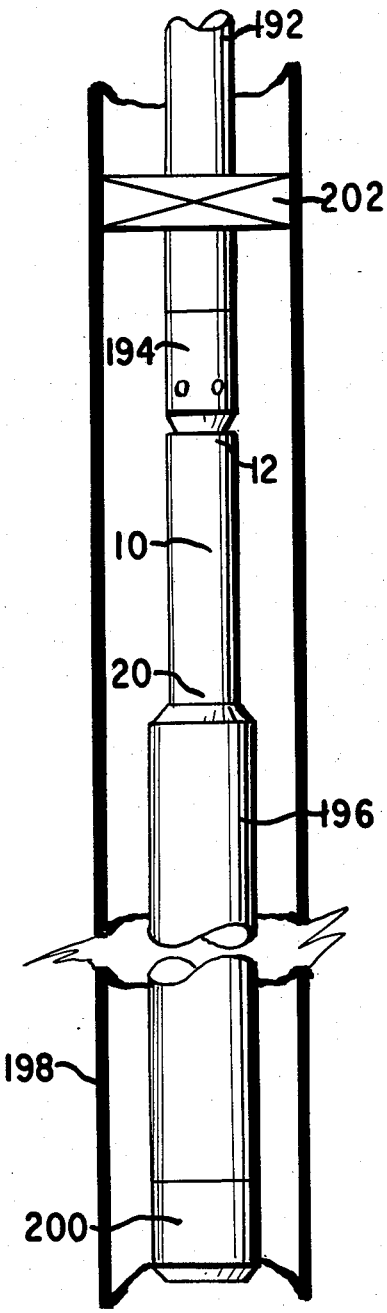
FIG. 5 is a partially cross-sectional view of a borehole in the earth wherein tubing conveyed perforating guns have been positioned to perforate the casing at a desired depth and utilizing the device of FIGS. 1–4.

One possible downhole arrangement utilizing the device of FIGS. 1–4 is shown is FIG. 5 illustrating a portion of a borehole formed in the earth and lined with a casing 190. A tubing string 192 terminates at its lower end by a perforated nipple 194. The upper sub 12 of the device 10 is threadedly coupled to the lower extremity of the nipple 194 and a lower portion 20 is threadedly coupled to a string of perforating guns 196 extending downwardly therefrom and positioned opposite a portion 198 of the casing 190 which it is desired to perforate with the guns 196. Coupled to the guns at their lowermost extremity is a shot detection device 200 which is operative to provide a signal transmitted upwardly through the tubing string 192 to the wellhead after a time delay provided by a combustive time delay element incorporated within the shot detection device 200. Shot detection device 200 may be, for example, that disclosed in U.S. patent application Ser. No. 505,911 filed July 20, 1983 in the names of Edward A. Colle, Jr., et al. entitled METHOD AND APPARATUS FOR DETECTING FIRING OF PERFORATING GUN. Once the guns 196 have been positioned adjacent the desired location 198, a packer 202 carried by the tubing string 192 and positioned above the perforated nipple 194 is set to isolate the casing annulus therebelow from the annulus above the packer. If it is desired to perforate the casing with an underbalanced condition in the lower annulus, the hydrostatic pressure in the lower annulus is adjusted accordingly, for example by swabbing well fluids from the tubing string 192. When it is desired to fire the guns 196, the heavier fluid in the tubing 192 is replaced with a lighter fluid to give the desired underbalance and then the pressure in the tubing string is increased by an operator at the wellhead until the pins 36 (FIG. 1) shear causing the piston ram 30 to move downwardly very rapidly to impact the firing pin 66, thus shearing the pin 68 holding the pin 66 and ramming the projection 72 into the assembly 100 to initiate the combustive reaction within delay assembly 136. With reference again to FIG. 1, the downward motion of the piston ram 30 is arrested when the fins 42 thereof impact upon the upper plug 44. This impact generates a distinctive vibration which can be detected at the wellhead through acoustic sensors, for example in the manner described in U.S. patent application Ser. No. 505,911, identified hereinabove.

At this point the operator at the wellhead begins to reduce the pressure in the annulus beneath packer 202 as the combustive reaction proceeds within the assembly 136. When the desired downhole pressure has been achieved, the combustive reaction within assembly 136 terminates with the detonation of the high explosive charge 176, thus detonating the guns 196. Several seconds after the firing of the guns, the device 200 emits a second vibrational signal through the tubing string to the surface in the event that the detonating cord within the guns 196 has detonated its entire length.

Figure 6:
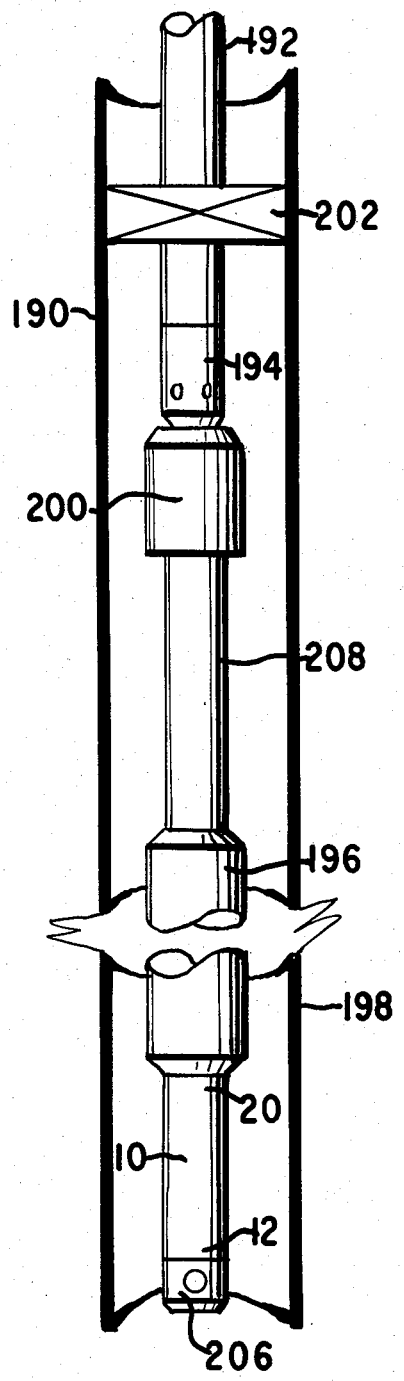
FIG. 6 is a partially cross-sectional view of a borehole in the earth illustrating a different arrangement for perforating the casing utilizing tubing conveyed perforating guns and utilizing the device of FIGS. 1–4.

The arrangement of FIG. 6 differs from that of FIG. 5 in that the device 10 has been mounted beneath the perforating guns 198 and in an upside-down arrangement so that its normally upper end 12 is now the lowermost portion of the device 10. A perforated bull plug 206 is threadedly coupled to end 12 of device 10 so that pressure within the annulus beneath the packer 202 can be applied to the piston 32 of device 10. The guns 198 are suspended from blank, fluid tight tubing 208 which in turn is suspended from the shot detection device 200. Device 200 is in turn coupled at its upper end to the perforated nipple 194. An advantage of the FIG. 6 arrangement is that if fluid pressure invades the guns 198 or blank tubing 208 prior to detonation, fluids will accumulate in the device 10. By utilizing a fluid sensitive detonator in device 10, so that fluid in the guns 198 accumulates below in the device 10, detonation of a wet string of guns can be prevented in the arrangement of FIG. 6.

In applications wherein long strings of guns are to be detonated by the device 10, requiring the use of boosters to transfer the detonation from one length of detonating cord to the next, it is preferable that non-directional boosters be employed. Such boosters include a single secondary high explosive which acts both as an acceptor and donor. The high explosive can be, for example, HMX compacted to a density of 1.71 gm/cc in a cup of guilding metal, stainless steel or aluminum, or PYX compacted to a density of 1.455 gm/cc in such a cup. An open end of the cup is then crimped over the end of the detonating cord.

The device of the present invention is also advantageous for use in drill stem testing, wherein non-fullbore opening devices are suspended in the tubing string above the perforating guns. Such devices render it difficult to pass a detonating bar downwardly through the tubing to impact upon a mechanical firing head, but do not affect the operation of a pressure actuated initiator such as device 10.

Other advantageous applications of the device 10 include multiple zone firing operations wherein two or more zones are to be perforated simultaneously or at different respective times. Such operations are disclosed in U.S. patent application Ser. No. 533,440, filed Nov. 18, 1983 entitled DETONATION OF TANDAM GUNS in the name of Flint R. George. Further uses for the present invention include the provision of redundant gun firing means, as disclosed in a U.S. patent application entitled REDUNDANT DETONATION INITIATORS FOR USE IN WELLS AND METHODS OF USE in the name of Edward A. Colle, Jr. and filed concurrently herewith.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

We claim:

1. A device for actuating an explosive charge downhole in a well bore, comprising:

first assembly which includes an impact piston;

a first primer assembly for initiating a combustive reaction and actuated in response to an impact thereto from the impact piston of the first assembly which is, in turn, responsive to a first pressure condition in at least a portion of the well bore produced by the manipulation of fluid pressure in the well bore from the surface thereof;

a second high output explosive charge for actuating said explosive charge; and a combustive delay means for providing a combustive reaction initiated by the first primer assembly and a continuing combustive reaction for a time delay period providing sufficient time for an operator to alter the first pressure condition to a second pressure condition desired at the time of explosive actuation, the combustive delay means continuing to provide a combustive reaction at the end of the time delay period after the initiation thereof to actuate the second high output explosive charge.

2. The device of claim 1 wherein the first assembly further comprises plug means for providing a signal adapted to be transmitted to the surface of the well bore when the plug means is impacted by a portion of the impact piston of the first assembly indicating the actuation of the first primer assembly.

3. The device of claim 1, further comprising means for maintaining the delay means below a predetermined pressure as the combustive reaction proceeds.

4. The device of claim 1 wherein the device is adapted to be mounted in a tubing string and adapted to produce the signal as a vibration of the anvil and to couple the vibration to the tubing string such that the signal is transmitted thereby to the surface of the well bore.

5. The device of claim 1, wherein the combustive delay means is operative to provide a time delay of at least 312 seconds at a downhole ambient temperature of at least 400° F.

6. The device of claim 5 wherein the device is operative to provide said time delay of at least 312 seconds after having been subjected to an average ambient temperature of at least 400° F. for at least 100 hours prior to the initiation of the first means.

7. The device of claim 1, wherein the delay means is operative to provide a time delay of at least 388 seconds at a downhole ambient temperature of at least 300° F.

8. The device of claim 7, wherein the device is operative to provide said time delay of at least 388 seconds after having been subjected to an average ambient temperature of at least 300° F. for at least 100 hours prior to the initiation of the first means.

9. The device of claim 1, wherein the delay means is operative to provide a time delay of at least 430 seconds at a downhole ambient temperature of at least 250° F.

10. The device of claim 9, wherein the device is operative to provide said delay of 430 seconds after having been subjected to an average ambient temperature of at least 250° F. for at least 100 hours prior to the initiation of the first means.

11. The device of claim 1, wherein the combustive means is disposed in a chamber to which it is adapted to release combustion gas as its combustive reaction proceeds; and the device further comprising means for venting the combustion gas released by the delay means from the chamber outwardly of the device whereby heat from the delay means is dissipated outside the device as the combustive reaction proceeds.

12. The device of claim 11, wherein the device is adapted to be mounted in a tubing string and adapted to vent the combustion gas into another element of the tubing string.

13. The device of claim 12, wherein said element is a carrier for the explosive charge.

14. The device of claim 11, wherein the device is adapted to be joined to a carrier of the explosive charge for actuating the charge and to vent the combustion gas into the carrier.

15. The device of claim 1, wherein the delay means is operative to provide an intermetallic reaction as said combustive reaction.

16. The device of claim 1, wherein the delay means is operative to provide said combustive reaction continuing for a period of time, while downhole in the well bore, which is substantially invariant at a given downhole ambient temperature.

17. A system for use in perforating a wall of a borehole extending from a ground level into the earth, comprising:

means for perforating the borehole wall in reponse to a stimulus;

means for supporting the perforating means adjacent a portion of the borehole wall to be perforated;

means for manipulating fluid pressure in the borehole from the groun level; and means for providing the stimulus to the perforating means after expiration of a time delay in response to an increase in fluid pressure in the borehole induced by the pressure manipulating means, the time delay of the stimulus providing means being of sufficient duration to permit a reduction in fluid pressure through the use of the pressure manipulating means to a level desired at the time the perforating means is actuated to perforate the borehole wall.

18. In a borehole, a method of perforating a wall of the borehole at a desired location and at a desired perforating pressure condition within the borehole adjacent the desired location, comprising:

positioning a perforating means adjacent the desired location;

increasing the pressure within the borehole adjacent the desired location from a first condition to a second, initiating pressure condition greater than the first condition and the desired perforating pressure conditions, to initiate a time delayed combustive reaction which, in turn, causes the performation of the wall of the borehole by the actuation of the perforating means; and thereafter, reducing the pressure within the borehole adjacent the desired location from the initiating pressure condition to the desired perforating pressure condition prior to the perforation of the wall of the borehole.

19. The method of claim 18, further comprising signalling the initiation of the time delayed perforation from the perforating means to a location remote therefrom to indicate that the pressure adjacent the desired location should be reduced.

20. The method of claim 19, wherein the step of initiating the time delayed perforation comprises striking a combustion initiator with a striker in response to the second pressure condition; and wherein the step of signalling the initiation of the time delayed perforation comprises producing a vibrational signal by impact of the striker against an anvil in response to the second pressure condition.

21. The method of claim 20, wherein the step of signalling the initiation of the time delayed perforation comprises coupling the vibrational signal to a tubing string run from the surface of the bore hole to the perforating means.

22. The method of claim 18, wherein the time delayed perforation occurs at least 312 seconds after the initiation thereof while the downhole ambient temperature is at least 400° F.

23. The method of claim 18, wherein the time delayed perforation occurs at least 388 seconds after the initiation thereof while the downhole ambient temperature is at least 300° F.

24. The method of claim 18, wherein the time delayed perforation occurs at least 430 seconds after the initiation thereof while the downhole ambient temperature is at least 250° F.

25. A device for actuating an explosive charge downhole in a well bore, comprising:

first means for providing an initiation signal in response to a first pressure condition in at least a portion of the well bore produced by the manipulation of fluid pressure in the well bore from the surface thereof;

combustive delay means responsive to the initiation signal for producing an actuation signal after a time delay period providing sufficient time for an operator to alter the first pressure condition to a second pressure condition desired at the time of explosive actuation; and means for actuating the explosive charge in response to the actuation signal.

26. The method of claim 18, wherein the step of reducing the pressure within the borehole comprises reducing the pressure to a desired perforating pressure which is less than pressure in an earth formation surrounding the location of the wall to be perforated.

27. The method of claim 18, wherein the step of reducing the pressure within the borehole comprises adjusting borehole pressure at the wellhead.

28. The method of claim 18, where the step of increasing the pressure within the borehole comprises adjusting borehole pressure at the wellhead.

29. The method of claim 19, further comprising the step of detecting the signal indicating the initiation of the time delayed perforation before carrying out the step of reducing pressure within the borehole.

* * * * *